US006899091B2

(12) United States Patent
Akiyama et al.

(10) Patent No.: US 6,899,091 B2
(45) Date of Patent: May 31, 2005

(54) BREATHER APPARATUS OF INTERNAL COMBUSTION ENGINE

(75) Inventors: Mamoru Akiyama, Tokyo (JP); Genichiro Ishii, Tokyo (JP)

(73) Assignee: Mitsubishi Fuso Truck and Bus Corporation (JP)

( * ) Notice: Subject to any disclaimer, the term of this patent is extended or adjusted under 35 U.S.C. 154(b) by 0 days.

(21) Appl. No.: 10/646,518

(22) Filed: Aug. 22, 2003

(65) Prior Publication Data

US 2004/0103889 A1 Jun. 3, 2004

(30) Foreign Application Priority Data

Aug. 23, 2002 (JP) ..... 2002-244151

(51) Int. Cl.[7] ..... F01M 13/04
(52) U.S. Cl. ..... 123/572; 123/41.86
(58) Field of Search ..... 123/572–574, 123/41.86

(56) References Cited

U.S. PATENT DOCUMENTS 4,103,650 A * 8/1978 Nishida et al. ..... 123/41.86
4,549,520 A * 10/1985 Tamba et al. ..... 123/572
4,667,647 A * 5/1987 Ohtaka et al. ..... 123/573
5,474,035 A * 12/1995 Ming et al. ..... 123/41.86
6,152,119 A * 11/2000 Hoshiba et al. ..... 123/572
6,234,154 B1 * 5/2001 Spix ..... 123/572
6,279,554 B1 * 8/2001 Sayama et al. ..... 123/572
6,334,438 B1 * 1/2002 Itoh et al. ..... 123/572
6,508,238 B2 * 1/2003 Furuya ..... 123/572
6,561,154 B2 * 5/2003 Ito et al. ..... 123/195 C

FOREIGN PATENT DOCUMENTS

JP 7-99088 10/1995

* cited by examiner

*Primary Examiner*—Maguerite McMahon
(74) *Attorney, Agent, or Firm*—Rossi, Kimms & McDowell

(57) ABSTRACT

A breather apparatus includes a first oil separation chamber disposed in a case and extending substantially in a vertical direction. The case constitutes a part of a vertical wall of an internal combustion engine, and blowby gas flows inside the case. A second oil separation chamber is superposed upon the first oil separation chamber. An opening formed in the lower part of the first oil separation chamber is communicated with the inside of the case. An upper part of the second oil separation chamber is communicated with the first oil separation chamber via a through hole. The blowby gas which has flown into the second oil separation chamber is supplied into an intake system via an outflow port formed in the lower part of the second oil separation chamber. In the separation chambers, oil in the blowby gas is separated by mutually different flow characteristics.

6 Claims, 4 Drawing Sheets

BREATHER APPARATUS OF INTERNAL COMBUSTION ENGINE

CROSS-REFERENCE TO RELATED APPLICATIONS

This application is based upon and claims the benefit of priority from the prior Japanese Patent Application No. 2002-244151, filed Aug. 23, 2002, the entire contents of which are incorporated herein by reference.

BACKGROUND OF THE INVENTION

1. Field of the Invention

The present invention relates to a breather apparatus of an internal combustion engine, which separates and collects an oil content in blowby gas.

2. Description of the Related Art

A blowby gas passing through sliding portions of a piston and cylinder and leaking from an engine main body includes an oil content. Therefore, a breather apparatus is attached to an engine (internal combustion engine). Accordingly, the oil content in the blowby gas is separated, and oil is returned into inner components of the engine such as an oil pan.

Usually in a recipro engine, the breather apparatus for separating the oil content from the blowby gas is disposed in an inner surface of a cam cover attached to an upper part of a cylinder head. Since the breather apparatus is built in the cam cover in this structure, an overall height of the engine main body increases.

In the engine whose overall height is required to be lowered, the breather apparatus is installed outside the engine main body. However, when the breather apparatus is installed outside the engine main body, a place for mounting the breather apparatus has to be secured in a limited small engine room. Additionally, a hose needs to be used to connect the engine main body to the breather apparatus, and it is necessary to circulate the blowby gas or the collected oil in the hose. Therefore, it is necessary to secure a place for disposing the hose in the engine room. Additionally, there is a problem that a structure around the engine main body becomes complicated.

Therefore, for example, as in the breather apparatus disclosed in Jpn. Pat. KOKOKU Publication No. 7-99088, it has been proposed that an oil separation chamber be formed in the inner surface of a chain cover attached to the engine.

The breather apparatus is requested to enhance a capability to separate the oil. Therefore, the separation chamber having a large capacity is required. However, only a limited space can be secured inside the chain cover because of various disposed apparatuses, and it is difficult to secure a large-sized separation chamber inside a chain case.

BRIEF SUMMARY OF THE INVENTION

An object of the present invention is to provide a breather apparatus in which space saving and enhanced oil separation characteristics can both be achieved.

According to the present invention, there is provided a breather apparatus in which an oil content in a blowby gas generated inside an internal combustion engine is separated and collected in the engine, comprising:

a first oil separation chamber which is disposed in a vertical wall constituting a part of an outer wall of the internal combustion engine and which extends substantially in a vertical direction of the internal combustion engine and including an opening formed in a lower part of the first oil separation chamber to introduce the blowby gas; and a second oil separation chamber which is superposed upon the outside of the first oil separation chamber and which is disposed in the vertical wall and which includes a through hole connected to the first oil separation chamber in an upper part and an outlet port to exhaust the blowby gas in a position below the through hole.

By this constitution, one space secured in the vertical wall is used to attach two separation chambers, and the oil separation chamber having a large capacity per space is secured. Additionally, since flow characteristics of the blowby gas differ in two separation chambers, a general oil separation capability is enhanced.

According to one example, the first oil separation chamber includes: a concave depression which is disposed in an outer surface of the vertical wall to extend substantially in a vertical direction and which is recessed in the vertical wall; and a partition wall with which the concave is covered. The second oil separation chamber includes: the partition wall; and a cover member with which the partition wall is covered and which is attached to the outer surface of the vertical wall.

According to one example, the vertical wall is a front wall of the internal combustion engine. In one example, the first oil separation chamber is inclined/disposed so that a distance between a center line extending vertically along the internal combustion engine and a lower end of the first oil separation chamber is larger than that between the center line and an upper end of the first oil separation chamber.

For example, the first oil separation chamber includes a collision plate system in which the blowby gas is allowed to collide with a collision plate to separate the oil content, and the second oil separation chamber includes a cyclone system in which the oil content is separated by a centrifugal force of the blowby gas.

According to one example of the present invention, the lower part of the second oil separation chamber is communicated with the first oil separation chamber via the through hole positioned below the opening of the first oil separation chamber. Oil reservoir portions having shapes tapered toward the lower ends may also be formed in the lower parts of the first and second oil separation chambers.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

One embodiment of the present invention will be described with reference to FIGS. 1 to 6.

Figure 1:
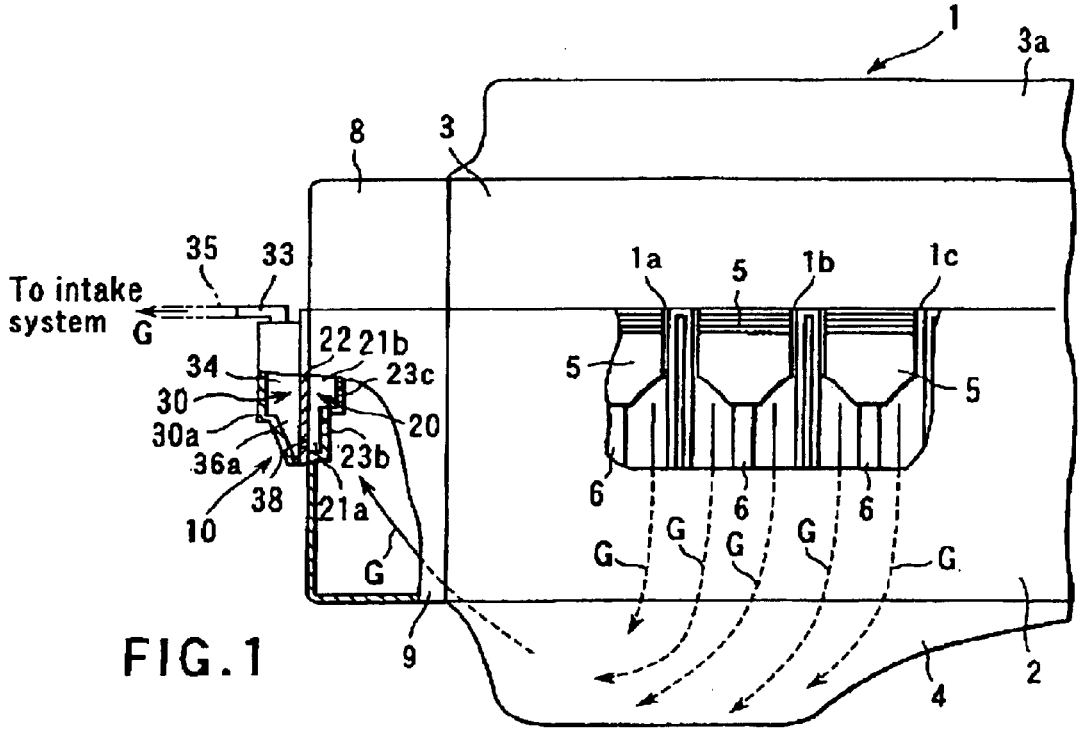
FIG. 1 is a partially sectional side view showing a breather apparatus according to one embodiment of the present invention together with an internal combustion engine.
Figure 2:
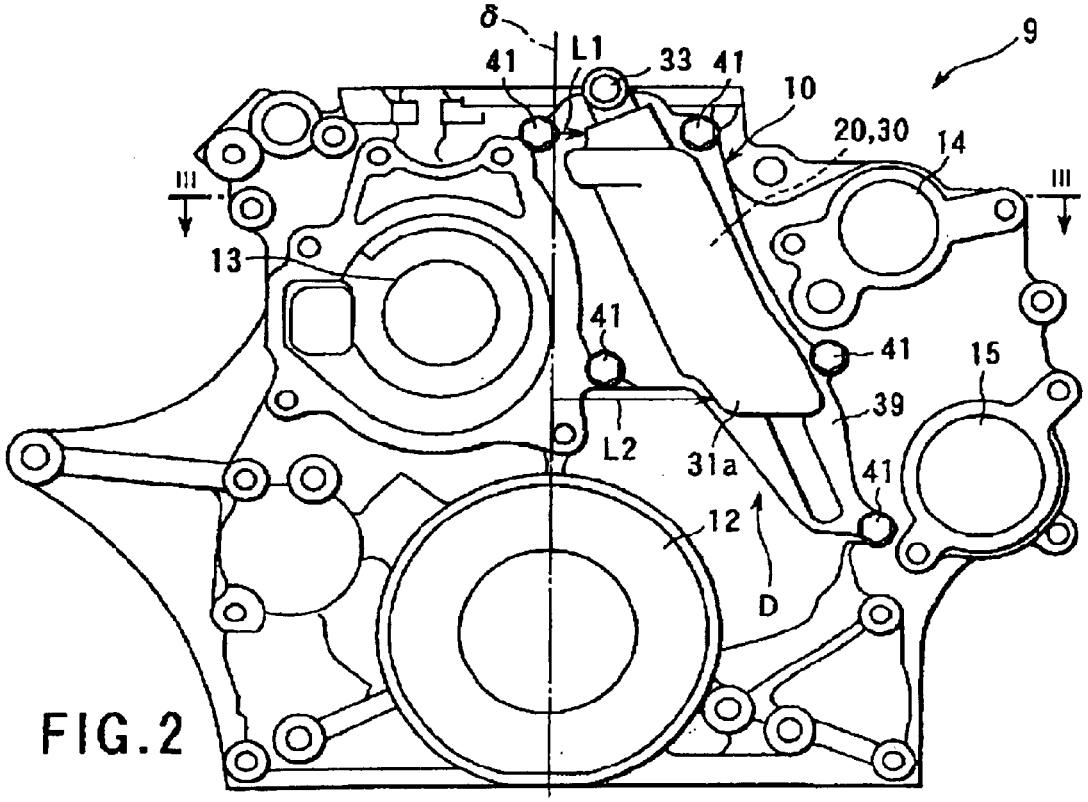
FIG. 2 is a front view showing a front wall of the internal combustion engine in which the breather apparatus shown in FIG. 1 is installed.
Figure 3:
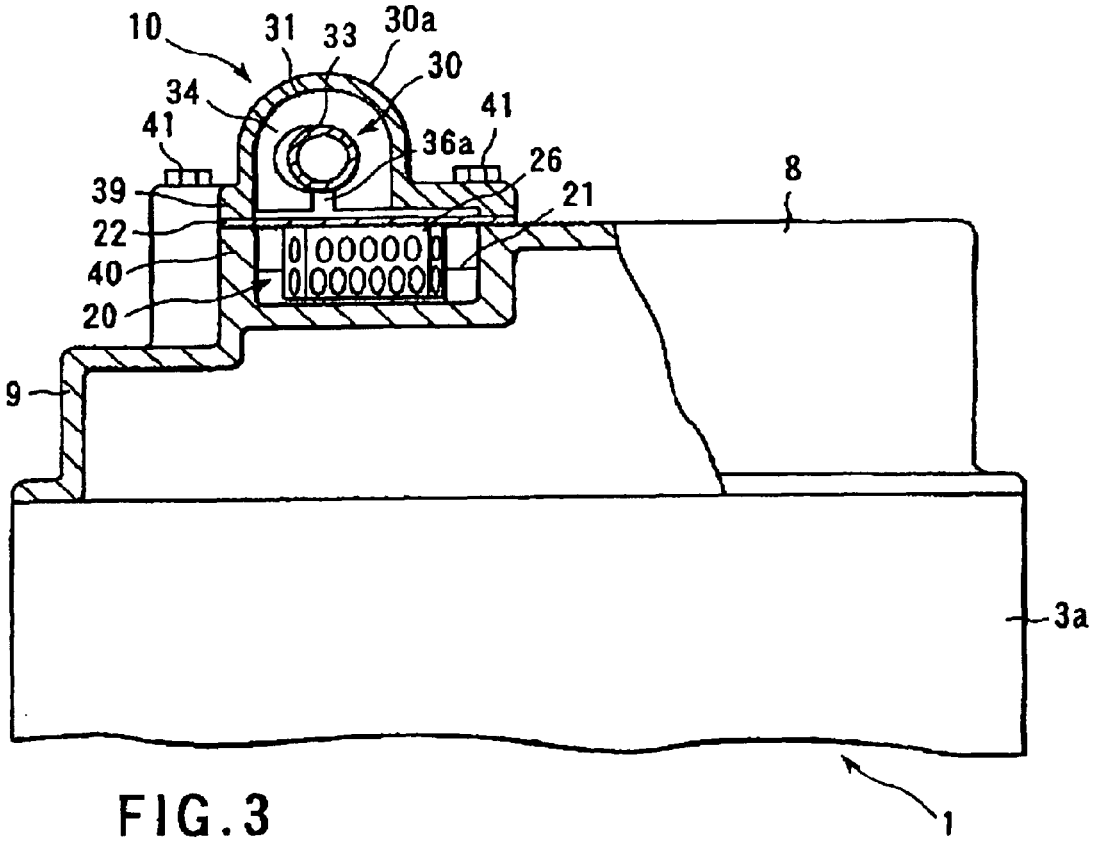
FIG. 3 is a sectional view of the breather apparatus taken along line in III—III of FIG. 2.
Figure 5:
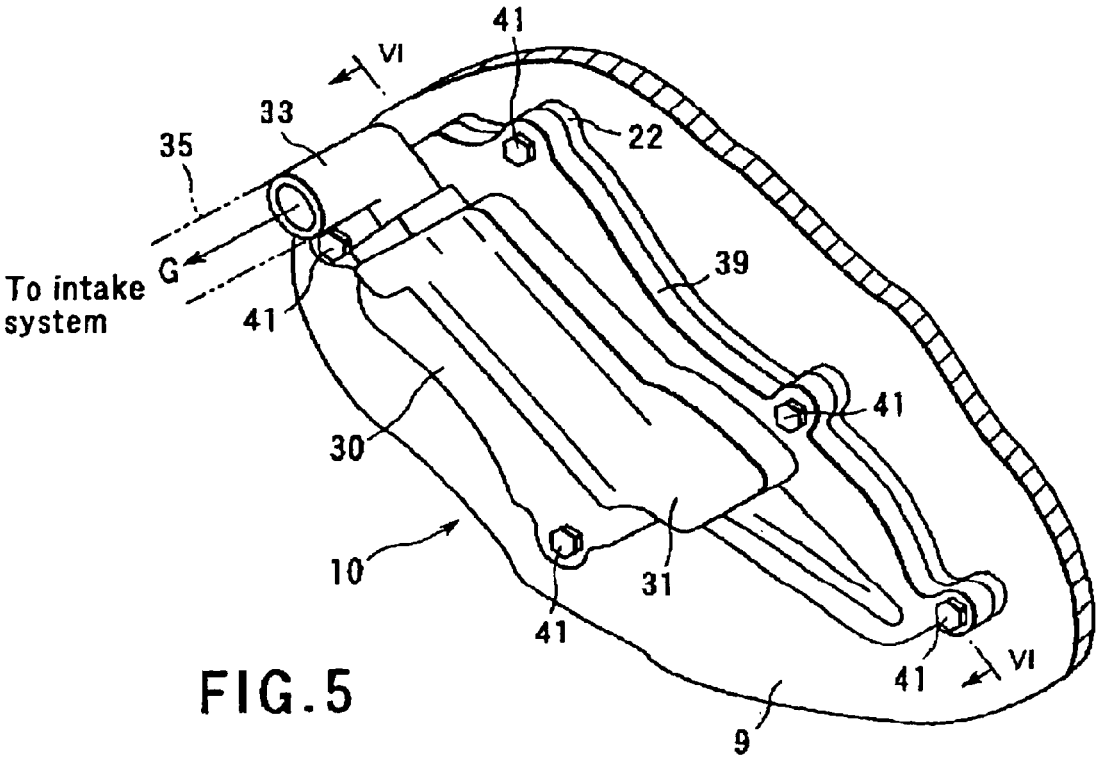
FIG. 5 is a perspective view showing an appearance of the breather apparatus shown in FIG. 1.

FIG. 1 shows an engine main body 1 of a recipro engine (corresponding to an internal combustion engine) mounted as one example of the internal combustion engine in a car. FIG. 2 shows a front surface of the engine. The engine main body 1 shown in FIG. 1 includes a cylinder block 2 in which, for example, cylinders 1*a* to 1*c* are arranged in series. A cylinder head 3 is mounted in an upper part of the engine main body 1. An oil pan 4 is disposed in a lower part of the engine main body 1. Pistons 5 are slidably contained in the cylinders 1*a* to 1*c*. The respective pistons 5 are rotatably connected to a crank shaft (not shown) via connecting rods 6. The crank shaft is attached to the lower part of the cylinder block 2.

A combustion chamber, an ignition plug, intake and exhaust valves driven by a cam shaft, and intake and exhaust ports opened/closed by the intake and exhaust valves (all are not shown) are disposed for each cylinder of the cylinder head 3. Timing gears for the intake and exhaust are attached to the cam shafts for the intake and exhaust valves. These timing gears are disposed before the cylinder head 3.

A crank gear (not shown) is attached to the crank shaft. This crank gear is disposed before the cylinder head 3. The timing gear is connected to the crank gear, for example, via a gear array. The intake and exhaust valves open/close at predetermined timings, each ignition plug operates at a predetermined timing, and accordingly, for example, a series of cycles of intake, compression, explosion, and exhaust are repeated in the respective cylinders 1*a* to 1*c*.

The timing gear exposed from the cylinder head 3 as well as peripheral apparatuses are covered with an upper gear case 8 with which a front end of the cylinder head 3 is covered. The crank gear exposed from the cylinder block 2 as well as the peripheral apparatuses are covered with a lower gear case 9 with which the front end of the cylinder block 2 is covered. An upper opening of the cylinder head 3 is covered with a cover 3*a*.

A breather apparatus 10 is disposed in the gear case 9 constituting a part of an outer wall of the engine in the engine main body 1. Blowby gas G produced in the engine (e.g., cylinder 1*a*) flows inside the gear case 9. The gear case 9 constituting a front wall of the engine main body 1 is an example of the vertical wall. The breather apparatus 10 is disposed in the gear case 9.

As shown in FIG. 2, the breather apparatus 10 is disposed in a vertically elongated dead space D in the gear case 9. The dead space D is formed among a water pump 13, vacuum pump 14, and power steering pump 15. In further detail, the breather apparatus 10 is disposed in the dead space D so as to avoid the apparatuses such as a crank pulley 12, and the water pump 13, vacuum pump 14, and power steering pump 15. The crank pulley 12 is disposed in the lower part of the gear case 9. The water pump 13 is disposed on the left side of a center line δ which extends in a vertical direction of the gear case 9. The vacuum pump 14 is disposed on the right side of the center line δ of the gear case 9.

Figure 4:
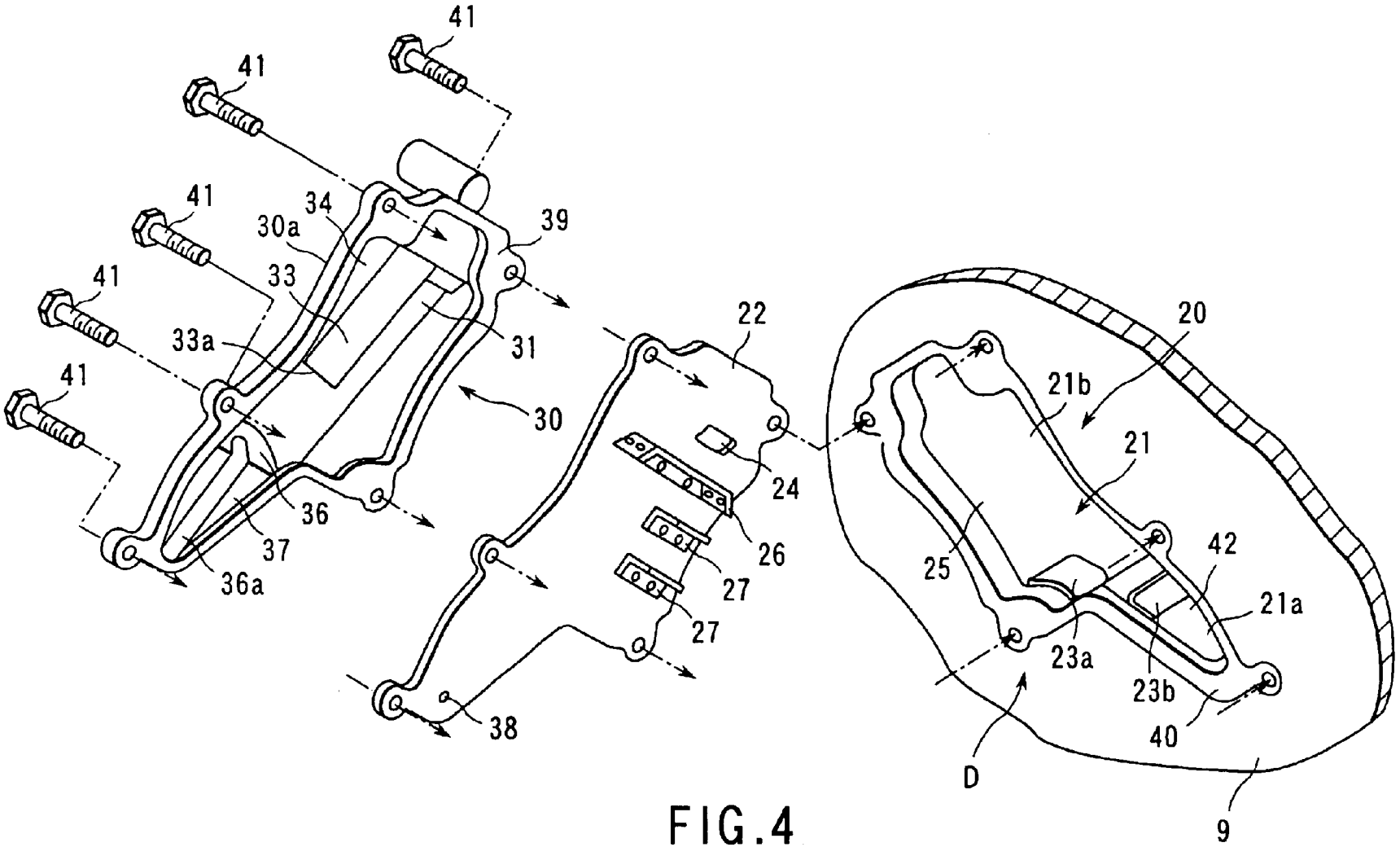
FIG. 4 is an exploded perspective view of the breather apparatus shown in FIG. 1.

A detailed structure of the breather apparatus 10 is shown in FIGS. 3 to 6. As shown in FIG. 4, a first oil separation chamber 20 is disposed in the dead space D. The oil separation chamber 20 includes a concave depression 21 having a shape elongated in the vertical direction, a partition wall 22 with which the opening of the concave depression 21 is covered, and the like. The concave depression 21 is formed in a part of the gear case 9. The partition wall 22 is constituted, for example, of a metal plate.

As shown in FIGS. 1 and 4, the concave depression 21 includes a shallow portion 21*a* positioned in the lower part, and a deep portion 21*b* positioned in the upper part. The shallow portion 21*a* constituting the lower part of the oil separation chamber 20 is formed in a shape tapered toward the lower end. A schematically quadrangular opening 23*a* is formed in the lower part of the deep portion 21*b*, and a schematically quadrangular opening 23*b* is also formed in the upper part of the shallow portion 21*a*. These openings 23*a*, 23*b* are connected to a space inside the gear case 9 where the blowby gas G flows. These openings 23*a*, 23*b* function as inlet portions for introducing the blowby gas G in the gear case 9 into the oil separation chamber 20.

For example, a quadrangular through hole 24 which functions as an outlet portion of the blowby gas G is formed in the upper part of the partition wall 22. The through hole 24 is positioned above the openings 23*a*, 23*b*. A channel 25 in which the blowby gas G flows upwards from below is formed by a space surrounded with the concave depression 21 and partition wall 22. A plurality of collision members with which the blowby gas G collides are attached to the inner surface of the partition wall 22 (surface which faces the concave depression 21). Examples of the collision members include a collision plate 26 which is laterally long, relatively large, and formed of a punching metal plate, and relatively small collision plates 27 which are positioned under the collision plate 26.

These collision plates 26, 27 constitute an oil separation mechanism of a collision system for separating an oil content in the blowby gas G. This oil separation mechanism is built in the first oil separation chamber 20. As shown in FIG. 2, the oil separation chamber 20 is inclined/disposed so that a distance L2 to the lower end of the oil separation chamber 20 from the center line δ of the engine main body 1 in the vertical direction is larger than a distance L1 to the upper end of the oil separation chamber 20 from the center line δ. When the oil separation chamber 20 is obliquely disposed in this manner, the oil separation chamber 20 can avoid the crank pulley 12 disposed in the lower part of the center line δ of the engine main body 1. Additionally, for this oil separation chamber 20, a sufficiently long effective length is secured in the dead space D.

As shown in FIG. 4, a second oil separation chamber 30 is disposed in the outer surface of the partition wall 22. This oil separation chamber 30 includes a cover member 30*a*. In the same manner as the concave depression 21 of the first oil separation chamber 20, the cover member 30*a* has a shape elongated in the vertical direction. The outer surface of the partition wall 22 is covered with the oil separation chamber 30, and the chamber is superposed upon the outside of the oil separation chamber 20. A semicylindrical portion 31 is formed in a region disposed opposite to the deep portion 21*b* of the oil separation chamber 20 in the cover member 30*a*.

The through hole 24 of the partition wall 22 is communicated with an eccentric position of an uppermost part of the semicylindrical portion 31. In a middle of the upper end of the semicylindrical portion 31, an exhaust tube 33 is disposed in the vertical direction. An outflow port 33*a* in the lower end of the exhaust tube 33 extends in the vicinity of the lower part of the semicylindrical portion 31. A cylindrical cyclone chamber 34 is formed around the exhaust tube 33.

The through hole 24 is the inlet port of the blowby gas G into the cyclone chamber 34. The outflow port 33*a* in the lower end of the exhaust tube 33 is an outlet port of the blowby gas G. The blowby gas G introduced into the cyclone chamber 34 via the through hole 24 causes a swirling flow as shown by an arrow F in FIG. 6. The cyclone chamber 34 constitutes a cyclone separation section in which the oil content included in the blowby gas G is separated based on a centrifugal force of the swirling flow of the blowby gas G.

The upper end of the exhaust tube 33 projects to an outer part of the oil separation chamber 30. The upper end of the exhaust tube 33 is communicated with an intake system (not shown) of the engine main body 1 via a hose 35. The outflow port 33*a* in the lower end of the exhaust tube 33 is positioned below the through hole 24 for communicating the oil separation chamber 20 with the oil separation chamber 30.

A table-shaped portion 36 which is shallower than the deep portion 21*b* is formed in a region opposite to the shallow portion 21*a* in the oil separation chamber 30. An oil reservoir portion 37 in which the separated oil is stored is formed between the table-shaped portion 36 and partition wall 22. A groove portion 36*a* is formed over to the lower end from the upper end of the table-shaped portion 36. An oil reservoir portion 42 is also formed in the lower part of the first oil separation chamber 20.

Figure 6:
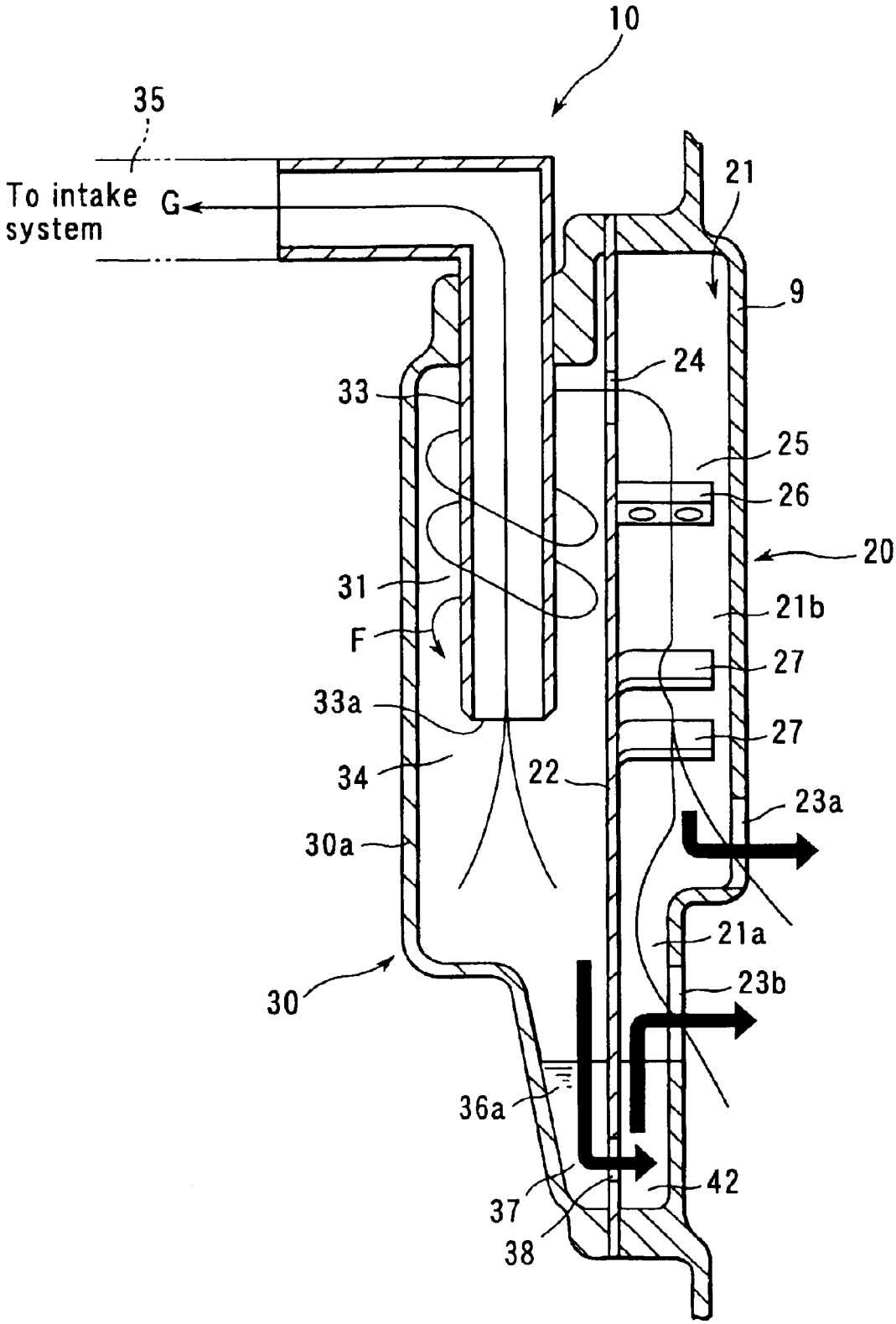
FIG. 6 is a sectional view of the breather apparatus taken along line VI—VI of FIG. 5.

A through hole 38 (corresponding to a communication portion) communicated with the lower part of the concave depression 21 is formed in the lower part of the partition wall 22 constituting the oil reservoir portion 37. As shown in FIG. 6, the through hole 38 is positioned below the openings 23*a*, 23*b*. The oil separation chamber 20 is communicated with the oil separation chamber 30 via this through hole 38. The lower opening 23*b* also serves as an oil return port. The oil stored in the oil reservoir portion 37 enters the gear case 9 via the opening 23*b*, and is returned into the engine, for example, the oil pan 4.

A flange 39 is formed in a circumference of the cover member 30*a* constituting the oil separation chamber 30. This flange 39 is superposed upon a washer 40 formed in a peripheral edge of the concave depression 21 of the oil separation chamber 20, and fixed to the washer 40 by fastening members such as bolts 41. In this manner, the breather apparatus 10 including a double structure in which two oil separation chambers 20, 30 are superposed upon each other is constituted.

Next, a function of the breather apparatus 10 will be described.

An intake negative pressure of the engine main body 1 acts on the exhaust tube 33. By the intake negative pressure, as shown in FIG. 6, the blowby gas G flowing in the gear case 9 is taken into the first oil separation chamber 20 via the openings 23*a*, 23*b*. The blowby gas G flows upwards in the channel 25 to flow toward the through hole 24. When the blowby gas G passes through the channel 25, the gas collides with the lower collision plate 27 and the upper collision plate 26 of the punching metal plate, and accordingly the oil content in the blowby gas G is separated. The oil separated from the blowby gas G is stored in the oil reservoir portion 42 in the lower part of the oil separation chamber 20.

The blowby gas G which has passed through the first oil separation chamber 20 flows into the second oil separation chamber 30 via the through hole 24. In the second oil separation chamber 30, the blowby gas G passes through the cyclone chamber 34 and flows downwards. In the cyclone chamber 34, the oil content remaining in the blowby gas G is further separated by the centrifugal force brought about by the swirling flow of the blowby gas G. The cyclone-separated gas returns into the intake system of the engine main body 1 from the outflow port 33*a* in the lower end of the exhaust tube 33 via the hose 35, and is used in combustion together with air for the combustion.

As shown in FIG. 6, the oil separated from the blowby gas G in the cyclone chamber 34 is stored in the oil reservoir portion 37 in the lower part of the oil separation chamber 30. The stored oil flows into the oil reservoir portion 42 of the first oil separation chamber 20 via the through hole 38. The oil stored in the oil reservoir portion 42 flows out into the gear case 9 via the opening 23*b* which is the inlet port of the blowby gas G, and is collected in the engine main body 1.

This breather apparatus 10 is constituted of two oil separation chambers 20, 30 superposed upon the outer wall (e.g., gear case 9) of the engine main body 1 in which the blowby gas G flows. That is, the breather apparatus 10 includes two types of oil separation chambers 20, 30 attached to one installation space which has a limited size. Therefore, in the breather apparatus 10, the space is saved, and a large capacity is secured.

Additionally, the oil is separated by the collision/separation of the blowby gas G which flows upwards in the first oil separation chamber 20, and the oil is separated by the swirling flow of the blowby gas G which flows downwards in the second oil separation chamber 30. The flow characteristics of the blowby gas G which differs in a mutual flow direction are used to separate the oil. Therefore, together with the enlarged capacity of the breather apparatus 10, a general oil separation capability increases.

In the breather apparatus 10, both the space saving and the enhanced oil separation capability can be achieved. Therefore, the apparatus is suitable for the engine which is requested to be miniaturized and enhanced in the oil separation capability. Additionally, the oil of relatively large particles is separated by the collision plate system in the first oil separation chamber 20, and the oil of relatively small particles is separated by the cyclone system in the second oil separation chamber 30. Therefore, the oil content can efficiently be separated in the whole breather apparatus 10.

Additionally, the second oil separation chamber 30 including the partition wall 22 and cover member 3*a* is superposed upon the first oil separation chamber 20 including the concave depression 21 to constitute the breather apparatus 10. Accordingly, projecting amounts of the oil separation chambers 20, 30 to the inside and outside of the engine main body 1 are small. This can restrict the outer shape dimension of the engine main body 1 from being increased by the oil separation chambers 20, 30, and influences of the inside of the engine main body can be restricted. When the partition wall 22 of a steel plate is used, the partition wall 22 is easily manufactured. Additionally, the members for the collision/separation (e.g., the collision plates 26, 27) can easily be attached to the partition wall 22 by components for fixing the members, such as screws.

The breather apparatus 10 is disposed in the gear case 9 which constitutes the front wall of the engine main body 1. The oil separation chambers 20, 30 are inclined/disposed so that the distance L2 to the lower end of the oil separation chamber from the center line δ along the vertical direction of the engine is larger than the distance L1 to the upper end. Accordingly, the oil separation chambers 20, 30 can be disposed with a large effective length avoiding obstacles such as the crank pulley 12 disposed in the lower part of the gear case 9 and the peripheral apparatuses. Therefore, the breather apparatus 10 is attached to the gear case 9 including many obstacles, and can fulfill a high oil separation capability.

The first oil separation chamber 20 is communicated with the second oil separation chamber 30 via the through hole 38 positioned below the openings 23*a*, 23*b* which are the inflow ports of the blowby gas G. The opening 23*b* for allowing the blowby gas G to flow in the first oil separation chamber 20 also functions as the outflow port for returning the oil separated from the blowby gas G in the oil separation chambers 20, 30 back into the engine main body 1. Therefore, a collection path of the oil separated from the blowby gas G is simple. Additionally, the oil reservoir portions 37, 42 disposed in the lower parts of the oil separation chambers 20, 30 have shapes tapered toward the lower ends. Therefore, the amount of oil accumulated in the respective oil separation chambers 20, 30 is small, and the oil can efficiently be returned to the engine main body 1.

It is to be noted that the present invention is not limited to the above-described embodiment, and can variously be modified and carried out without departing from the scope of the present invention. For example, in the above-described embodiment, the breather apparatus is disposed in the gear case, but the present invention is not limited to this, and the breather apparatus may also be disposed in the vertical wall other than the gear case.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general invention concept as defined by the appended claims and their equivalents.

What is claimed is:

1. A breather apparatus of an internal combustion engine for collecting from blowby gas generated inside the internal combustion engine, comprising:

a first oil separation chamber defined by a substantially vertical outer wall of the internal combustion engine and extending substantially in a vertical direction of the internal combustion engine, and including at least one opening formed in a lower part thereof through the substantially vertical outer wall for introducing the blowby gas;

a second oil separation chamber disposed adjacent to the first oil separation chamber and including an outflow port for substantially vertically exhausting the blowby gas out of the second oil separation chamber; and a partition wall separating the first and second oil separation chambers, and having a first through hole for communicating the first and second oil separation chambers, wherein the outflow port is disposed below the first through hole.

2. The breather apparatus according to claim 1, wherein the first oil separation chamber is defined by a concave depression recessed in the substantially vertical wall and extending substantially in a vertical direction, and wherein the second oil separation chamber is defined by a cover member attached to an outer side of the vertical wall, with the partition wall dividing the first and second oil separation chambers.

3. A breather apparatus of an internal combustion engine for collecting oil from blowby gas generated inside the internal combustion engine, comprising:

a first oil separation chamber disposed in a substantially vertical outer wall of the internal combustion engine and including at least one opening formed in a lower part thereof for introducing the blowby gas; and a second oil separation chamber disposed adjacent to the first oil separation chamber and including a through hole connecting the first oil separation chamber in an upper part thereof and an outflow port for exhausting the blowby gas disposed below the through hole, wherein the substantially vertical wall is a front wall of the internal combustion engine, and the first oil separation chamber is disposed so that a distance between a center line extending vertically along the internal combustion engine and a lower end of the first oil separation chamber is larger than that between the center line and an upper end of the first oil separation chamber.

4. A breather apparatus of an internal combustion engine for collecting oil from blowby gas generated inside the internal combustion engine, comprising:

a first oil separation chamber disposed in a substantially vertical outer wall of the internal combustion engine and including at least one opening formed in a lower part thereof for introducing the blowby gas; and a second oil separation chamber disposed adjacent to the first oil separation chamber and including a through hole connecting the first oil separation chamber in an upper part thereof and an outflow port for exhausting the blowby gas disposed below the through hole, wherein the first oil separation chamber includes a collision plate in which the blowby gas is allowed to collide with the collision plate to separate the oil, and the second oil separation chamber includes a cyclone chamber in which the oil is separated by a centrifugal force of the blowby gas.

5. The breather apparatus of the internal combustion engine according to claim 1, wherein the partition wall further includes a second through hole formed at a lower position than the opening of the first oil separation chamber so that a lower part of the second oil separation chamber communicates with the first oil separation chamber via the second through hole.

6. A breather apparatus of an internal combustion engine for collecting oil from blowby gas generated inside the internal combustion engine, comprising:

a first oil separation chamber disposed in a substantially vertical outer wall of the internal combustion engine and including at least one opening formed in a lower part thereof for introducing the blowby gas; and a second oil separation chamber disposed adjacent to the first oil separation chamber and including a through hole connecting the first oil separation chamber in an upper part thereof and an outflow port for exhausting the blowby gas disposed below the through hole, wherein oil reservoir portions having shapes tapered toward the lower ends are formed in the lower parts of the first and second oil separation chambers.

* * * * *